US005176048A

United States Patent [19]

Jore et al.

[11] Patent Number: 5,176,048

[45] Date of Patent: Jan. 5, 1993

[54] PLIERS HAVING SUBSTANTIALLY PARALLEL JAW MOVEMENT

[76] Inventors: Matthew B. Jore, 2120 Hummingbird; Kenneth D. Richardson, 15955 Mullan Rd., both of Missoula, Mont. 59802

[21] Appl. No.: 502,274

[22] Filed: Mar. 29, 1990

[51] Int. Cl.[5] ..... B25B 7/12

[52] U.S. Cl. ..... 81/352; 81/406; 81/416

[58] Field of Search ..... 81/352–354, 81/406, 409.5, 416

[56] References Cited

U.S. PATENT DOCUMENTS

| | | | |
|---|---|---|---|
| 656,394 | 8/1900 | Deiters et al. | 81/406 |
| 1,206,199 | 11/1916 | Blodgie | 81/353 X |
| 3,685,097 | 8/1972 | Scott et al. | 81/416 X |

OTHER PUBLICATIONS

Machine Design; "Pins and Slots Adjust Wrench Grip"; p. 55, Jan. 9, 1986.

*Primary Examiner*—James G. Smith
*Attorney, Agent, or Firm*—Richard C. Conover

[57] ABSTRACT

An improved plier tool having a pair of crossed handle members each having a jaw at one end. The first of said handle members having a circular bore therethrough with the bore having an inner surface providing a first cam surface. A first disc-shaped cam positioned within this bore for rotation. The first cam further having an axle pin eccentrically mounted to the first cam and fixedly mounted to the second of said handle members. Further, a guide cam pin carried by the first handle member is positioned in spaced apart relation to the bore carrying the disc-shaped cam. A slot formed in the second member is spaced apart from the axle pin and is positioned to receive the guide cam pin. The slot having a second and third cam surface for bearing against the pivot pin. The first cam surfce in the first member and the second cam surface in the slot being respectively shaped to guide the jaw portions of the crossed members to maintain a substantially parallel relationship of the jaw portions when the pliers are being opened. The first cam surface and the third cam surface being respectively shaped to guide the jaw portions of the crossed members to maintain a substantially parallel relation when the jaw portions are being closed.

3 Claims, 3 Drawing Sheets

PLIERS HAVING SUBSTANTIALLY PARALLEL JAW MOVEMENT

BACKGROUND OF THE INVENTION

This invention relates to an improved pliers and more specifically, to pliers which maintain cooperating jaws in a substantially parallel relationship when crossed handle members are moved to move the jaws from a closed position to an open position.

Tongue and groove pliers are often used to incrementally adjust a pivotal axis about which crossed handle members pivot, which members carry cooperating jaws to maintain an approximate parallel relation between the jaws when the jaws are opened to grasp an object. With this adjustable pivot, the jaws are held approximately parallel when the jaws are opened or closed. These tongue and groove pliers have a number of curved channels or grooves on one handle for receiving a tongue member carried by the other handle. The tongue can be manually and incrementally shifted from one channel to another to adjust the pivot point between the handles so as to obtain approximate parallel movement of the jaws when the jaws are being opened. Difficulties with using this type of pliers arises when a user must guess which channel to use for grasping a particular object.

To overcome the problem of incrementally shifting a tongue to a new groove, pliers have been developed using cams for incrementally adjusting the pivotal axis between the crossed members while a tool is being used to accommodate different sized objects grasped by the tool. U.S. Pat. No. 656,394 to Deiters & Bill; U.S. Pat. No. 163,642 to Dean; and U.S. Pat. No. 228,333 to Fawcett all illustrate the use of a cam to change the position of the pivotal axis as the jaws of the pliers are being opened or closed. In these devices, however, a pawl is used in cooperation with holes or teeth to incrementally lock the pivotal axis between the crossed members at predetermined points. Another patent, U.S. Pat. No. 3,685,097 to Scott, illustrates a clam opener tool having a variable pivot point joining a pair of plier members. The tool includes a slot receiving a pin and a first and second cam members which engage each other at a predetermined position to increase the mechanical advantage as the jaws are being closed. The first and second cam members are operative only when the jaws are being closed.

It is an object of the present invention to provide a pair of pliers where the jaws of the pliers are maintained substantially parallel when the pliers are manipulated from a closed position to an open position or vice versa. It is a further object of this invention to enable a user to fully manipulate this pair of pliers with one hand with the pivot point being changed continuously and automatically by cooperating cam members as the plier jaws are being open-ed or closed.

SUMMARY OF INVENTION

The improved plier tool according to one embodiment of the present invention includes a pair of pivotally joined crossed handle members each having a jaw at one end thereof. The jaw portions being cooperatively positioned with respect to one another to be manipulated from a position with the jaws closed to a position with the jaws opened. The first of said handle members having a circular bore therethrough with the bore having an inner surface providing a first cam surface. A first disc-shaped cam is positioned within this circular bore of the first member for rotation about a central axis of rotation. The first cam further includes a bore therethrough positioned eccentrically to the axis of rotation of the first cam. The second of said handle members carries a pivot pin, the pivot pin being positioned to extend from the first member through the bore in the first cam. The pin is provided with a head at one end and a nut at the other end so that the pivot pin in cooperation with other structure is provided for retaining the handle members together for swinging movement with respect to one another and with respect to the pivot pin.

A guide cam pin carried by the first member is positioned in spaced apart relation to the bore carrying the first cam in the first member. A slot formed in the second member is spaced apart from the pivot pin and is positioned to receive the guide cam pin. The slot having second and third cam surfaces for bearing against the pivot pin. The first cam surface in the first member and the second cam surface in the slot being respectively shaped to guide the jaw portions of the crossed members to maintain a substantially parallel relation of the jaw portions when the pliers are being opened. The first cam surface in the first member and the third in the slot being respectively shaped to guide the jaw portions of the crossed members to maintain a substantially parallel relation of the jaw portions when the pliers are being closed.

BRIEF DESCRIPTION OF THE DRAWINGS

In order that the invention may be clearly understood and readily carried into effect, preferred embodiments of the invention will now be described, by way of example only, wherein.

DESCRIPTION OF PREFERRED EMBODIMENTS

Figure 1:
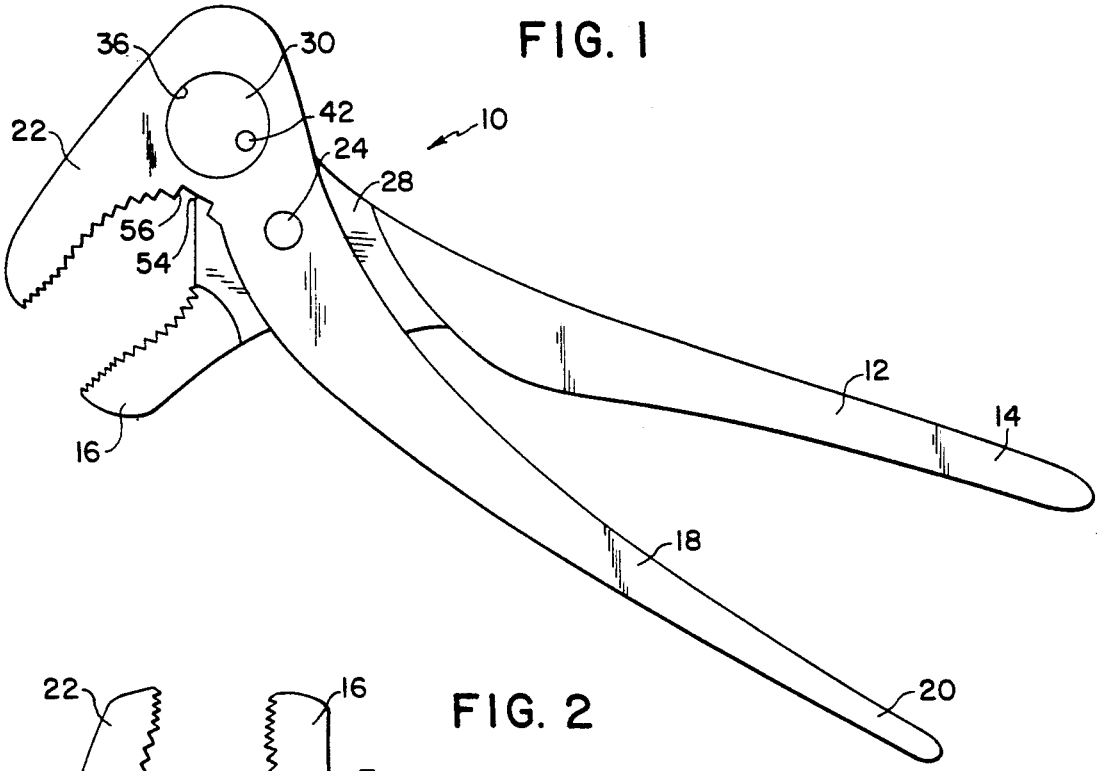
FIG. 1 is a top view of the improved plier tool according to the present invention with the jaws partially opened.

A preferred embodiment of the plier tool 10 according to the present, invention is shown in FIG. 1. The pliers 10 include a second elongate member 12 having a handle 14 at one end thereof and a jaw portion 16 at the other end thereof. A first elongate member 18 also has a handle 20 at one end thereof and a corresponding jaw 22 at the other end thereof.

Figure 3:
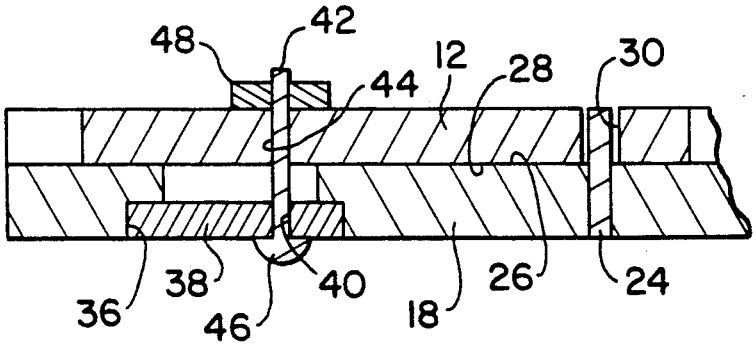
FIG. 3 is a cross section of a portion of the plier tool taken along line 3—3 in FIG. 2.
Figure 4:
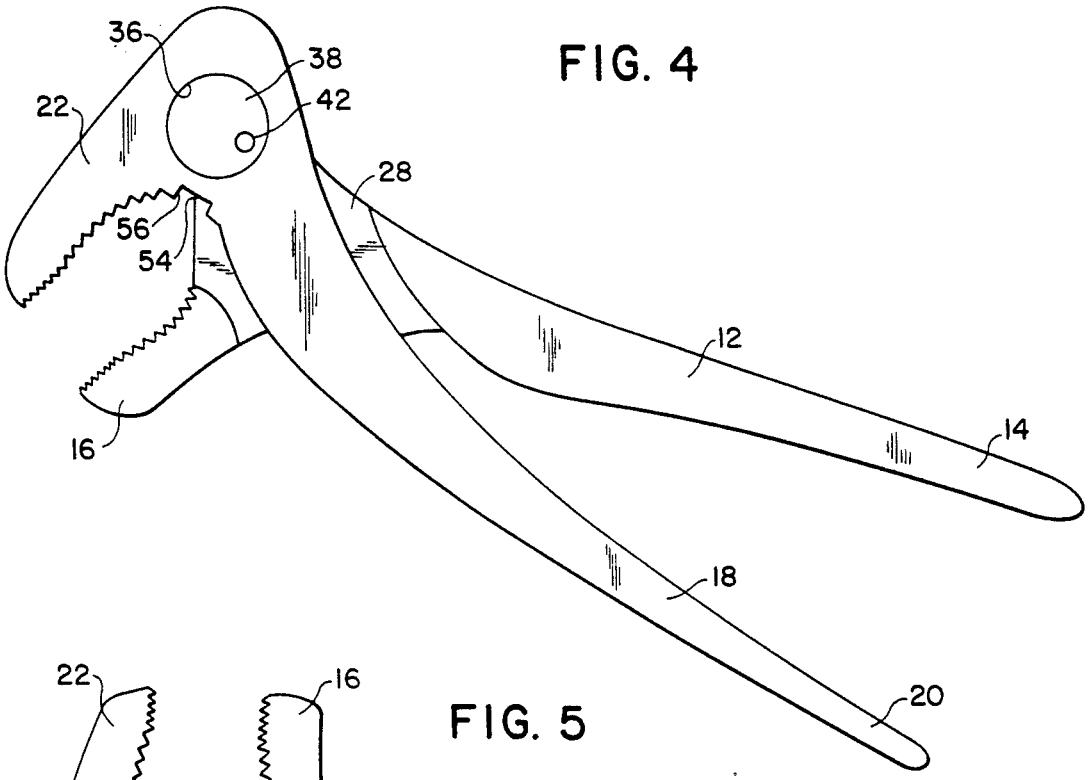
FIG. 4 is a top view of a second embodiment of an improved plier tool according to the present invention with the jaws partially open.

Elongate member 18 includes a stepped circular bore 36 therethrough as best shown in FIG. 3 with the larger bore located outwardly of the inner bore. This step bore 36 is located in a flattened surface portion 26 of elongate member 18. A disc-shaped cam 38 is located in the outer bore of stepped bore 36 and is mounted for rotational slidable movement therein about its center axis of rotation. The inside surface of bore 36 provides a first cam surface for cam 38. The cam 38 further includes a bore 40 therethrough which bore is eccentrically positioned relative to the axis of rotation of this first cam 38. A pivot pin 42 is positioned in the bore 40 and extends through a corresponding bore 44 located in the flattened surface portion 28 of member 12. The pivot pin 42 is provided with a head 46 at one end thereof and is further provided with a nut 48 which is threaded on the opposite end of pivot pin 42 whereby the members 12 and 18 are sandwiched together with the cam 38 resting against the step of bore 36 as shown in FIG. 3.

A cylindrical guide cam pin 24 is fixedly mounted in a hole in member 18 to extend from the flattened surface portion 26 on elongate member 18 generally near jaw portion 22. A flattened surface portion 28 is provided on member 12 generally near jaw portion 16 which includes a slot 30 extending through member 12 and within which the guide cam pin 24 is located. The slot includes a second and third cam surfaces 34 and 32 respectively, for bearing against the guide cam pin 24, as will be described subsequently.

Jaw 16 and jaw 22 are held in cooperating positions and may be opened using two separate cam actions: one from the closed position to an intermediate open position, and a second from the intermediate open position to a full open position. As jaws 16 and 22 are opened in the range from the closed position to the intermediate open position, the disc-shaped first cam 38 rotates within bore 36 to vary the pivotal axis between members 12 and 18. Guide cam pin 24, during this movement, follows second cam surface 34 of slot 30 and provides a fulcrum to rotate first cam 38 as handles 14 and 20 are opened. As cam 38 rotates in response to the handles being opened, pivot pin 42 carried by cam 38 moves toward guide cam pin 24. This movement of pin 42 toward guide cam pin 24 shifts the pivotal axis between members 12 and 18 so as to maintain a substantially parallel relationship between the jaws 16 and 22.

As jaws 16 and 22 are opened in the range from the intermediate open position to a full open position, the first cam 38 further rotates, and guide cam pin 24 slides in slot 30. In this range of movement, the pivotal axis between members 12 and 18 is such as to maintain a substantially parallel relationship between the jaws 16 and 22.

As jaws 16 and 22 are closed, the reverse of the opening process occurs except when the jaws are being moved between the intermediate open position to the fully closed position. The guide cam pin 24 engages third cam surface 32 in slot 30 to provide a fulcrum to rotate first cam 38 about its axis of rotation so as to move pivot pin 42 carried by first cam 38 away from guide cam pin 24. This relative movement of pin 42 and pin 24 acts to maintain the substantially parallel relationship between the jaws 16 and 22 as they are being closed.

Figure 2:
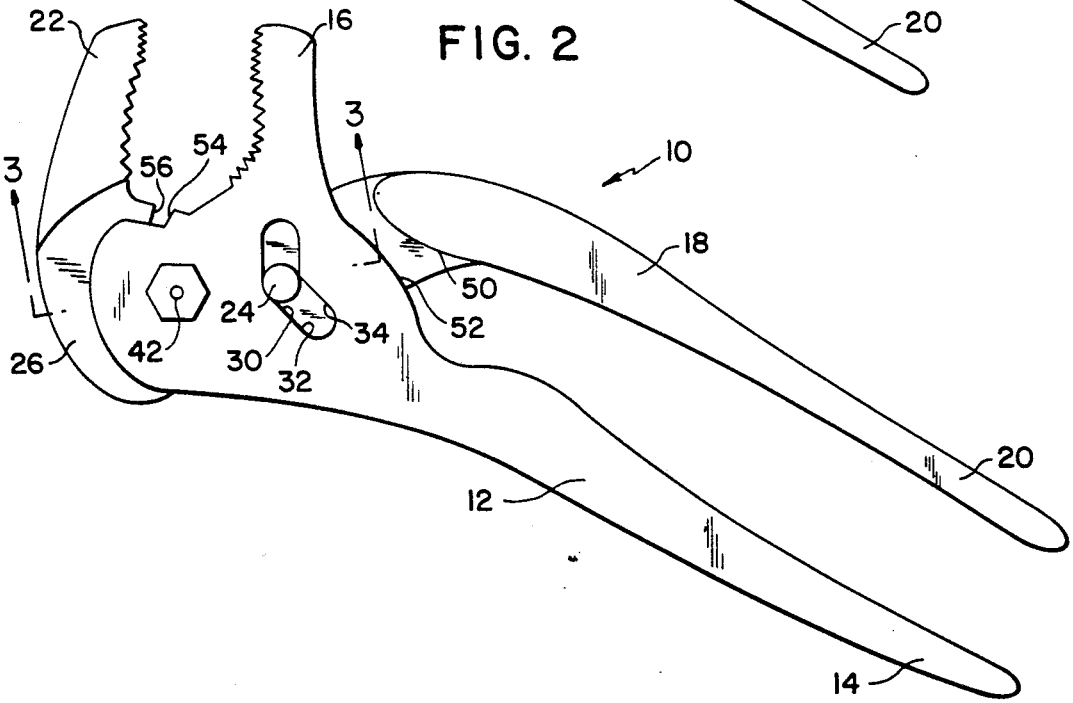
FIG. 2 is a bottom view of the improved plier tool shown in FIG. 1.

Elongate members 12 and 18 may be provided with conventional wire cutting edges 54 and 56 as shown in FIGS. 1 and 2 for cutting wire when the handles 14 and 20 are manipulated to a position where the jaws 16 and 22 are closed.

Figure 5:
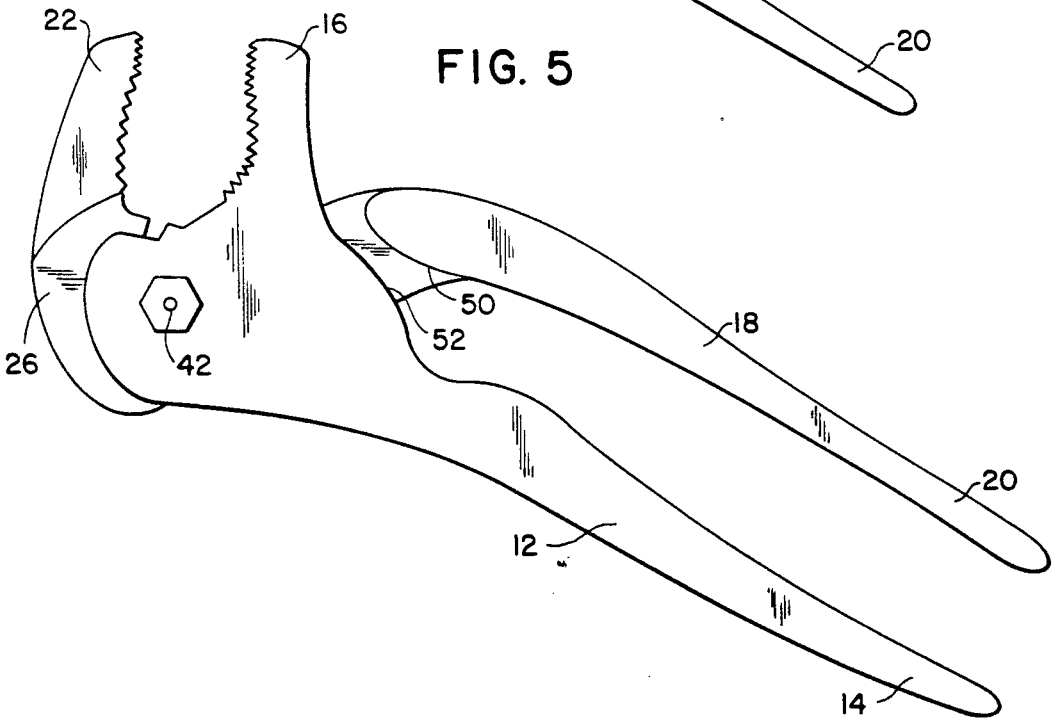
FIG. 5 is a bottom view of the second embodiment of the improved plier tool shown in FIG. 4.

As a second embodiment, the slot 30 and pin 24 are eliminated, and a fourth cam surface 50 is provided on handle 20 as seen in FIG. 5 for cooperating with cam 52 provided on elongate member 12. The fourth cam surface 50 and first cam engaging edge 52 are respectively shaped so that when handles 14 and 20 are squeezed together, fourth cam surface 50 and first cam engaging edge 52 act as a fulcrum to turn first cam 38 so to change the pivotal axis between elongate members 12 and 18. As the jaws are being closed, first cam 38 rotates toward jaw 22 to maintain the substantially parallel relationship between the jaws.

In a third embodiment, the slot 30 and pin 24 are utilized as in the first embodiment and further, the fourth cam surface 50 and cam 52 are provided as shown in FIG. 2. The pin 24 sliding along the second cam surface serves to rotate cam 38 when opening the pliers. When closing the pliers, the cam 52 engaging the fourth cam surface 50 serves to rotate cam 38.

With the present invention, a smoothly operating pair of pliers is provided having substantially parallel jaw movement between a jaw closed position and a jaw opened position.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. An improved plier tool comprising:

a pair of pivotally united crossed members each having a jaw portion, the jaw portions being cooperatively positioned with respect to one another to be manipulated from a position with the jaws closed to a position with the jaws open;

the first of said members having a bore therethrough, the bore being a circular stepped bore with a first diameter bore stepping down to a second smaller diameter bore, the bore further having an inner surface providing a first cam surface;

a first cam positioned within said bore of the first member, the first cam being a disc which rotates about its center axis within the first diameter bore, the first cam further having a bore therethrough positioned eccentrically to the center axis of the first cam;

a pivot pin carried by the second of said members, the pivot pin positioned to extend through the bore in the first member and the bore in the first cam;

means for retaining said members together for swinging movement with respect to one another and with respect to the pivot pin;

a guide cam pin carried by the first member, the guide cam pin being positioned in spaced apart relation to the bore in the first member;

a slot formed in the second member spaced apart from the pivot pin and positioned to receive the guide cam pin;

the slot having second and third cam surfaces for bearing against the pivot pin;

the first and second cam surfaces being respectively shaped to guide the jaw potions of the crossed members to maintain a substantially parallel relation to the jaw portions when the pliers are being opened, and the first and third cam surfaces being respectively shaped to guide the jaw portions of the crossed members to maintain a substantially parallel relation to the jaw portions when the pliers are being closed.

2. An improved plier tool according to claim 1 wherein the crossed members have cooperating wire cutting means for cutting wire when the crossed members are manipulated toward a position where the jaws are closed.

3. An improved plier tool comprising:

a pair of pivotally united crossed members each having a jaw portion, the jaw portions being cooperatively positioned with respect to one another to be manipulated from a position with the jaws closed to a position with the jaws open;

the first of said members having a bore therethrough, the bore having an inner surface providing a first cam surface;

a first cam positioned within said bore of the first member and being shaped for rotation about a central axis of rotation, the first cam further having a bore therethrough positioned eccentrically to the center axis of the first cam;

a pivot pin carried by the second of said members, the pivot pin positioned to extend through the bore in the first member and the bore in the first cam;

means for retaining said members together for swinging movement with respect to one another and with respect to the pivot pin;

the first member further having a fourth cam surface spaced apart from the first cam surface;

the second member having a cam for engaging the fourth cam surface which acts as a fulcrum to rotate the first cam when the crossed members are squeezed together;

the fourth cam surface being shaped to rotate the first cam when the pliers are being closed to guide the jaw portions of the crossed members to maintain a substantially parallel relation to the jaw portions when the pliers are being closed.

* * * * *